US007896093B2

(12) United States Patent
Chavez

(10) Patent No.: US 7,896,093 B2
(45) Date of Patent: Mar. 1, 2011

(54) LOCALIZED FIRE SUPPRESSION

(76) Inventor: Greg Chavez, Camarillo, CA (US)

( * ) Notice: Subject to any disclaimer, the term of this patent is extended or adjusted under 35 U.S.C. 154(b) by 312 days.

(21) Appl. No.: 11/947,621

(22) Filed: Nov. 29, 2007

(65) Prior Publication Data

US 2008/0289835 A1 Nov. 27, 2008

Related U.S. Application Data

(60) Provisional application No. 60/940,187, filed on May 25, 2007.

(51) Int. Cl.
*A62C 37/10* (2006.01)

(52) U.S. Cl. ..... 169/60; 169/9; 169/26; 169/29; 169/37; 169/56; 169/85; 340/592; 116/103; 116/216

(58) Field of Classification Search ..... 239/9, 239/26, 29, 37–41, 56, 60–62, 65, 85; 340/584, 340/592; 169/9, 26, 29, 37–41, 56, 60–62, 169/65, 85, 20, 42; 116/5, 103, 106, 216
See application file for complete search history.

(56) References Cited

U.S. PATENT DOCUMENTS 3,171,493 A 3/1965 Barr
4,113,020 A 9/1978 Panetta
4,356,868 A * 11/1982 Bentley et al. ..... 169/26
4,520,871 A * 6/1985 Miller et al. ..... 169/9
4,623,878 A 11/1986 Schoenwetter
4,709,763 A 12/1987 Jessick
5,018,586 A 5/1991 Cawley et al.
5,031,702 A 7/1991 Trumbach
5,236,049 A 8/1993 Asselin et al.
5,880,676 A 3/1999 Tsou
5,954,138 A * 9/1999 Gabriel ..... 169/20
6,003,610 A 12/1999 Kordes
6,021,852 A 2/2000 Barnett et al.
6,209,654 B1 * 4/2001 Curless ..... 169/37
6,244,353 B1 6/2001 Greer
6,382,582 B1 5/2002 Brown
7,416,030 B2 * 8/2008 Lupien et al. ..... 169/9

* cited by examiner

*Primary Examiner*—Steven J Ganey
(74) *Attorney, Agent, or Firm*—SoCal IP Law Group LLP; Steven C. Sereboff; John E. Gunther

(57) ABSTRACT

An apparatus to suppress a localized fire may include a pressurized tank of fire suppressant and a valve coupled to the tank. In case of a fire, a pneumatic fire sensor may open the valve to release the fire suppressant.

22 Claims, 5 Drawing Sheets

LOCALIZED FIRE SUPPRESSION

RELATED APPLICATION INFORMATION

Priority Claim Under Rule 1.78(a)(4): This patent claims priority from the following provisional patent application Ser. No. 60/940,187, filed May 25, 2007, entitled "Automatic Fire Protection System With Audible Alarm for a Christmas Tree".

Priority Claim Under Rule 1.78(a)(1): This patent claims priority from the following non-provisional patent applications: none.

Other related applications: none.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to controlling a localized fire such as, for example, a fire in a Christmas tree.

2. Description of the Related Art

Most homes and commercial buildings have smoke detectors, but many homes and some commercial buildings may not have installed fire sprinklers or other fire suppression systems. Even in homes and other buildings having fire sprinklers, localized fires may cause significant damage and risk to occupants before the smoke detectors and/or sprinkler system sense the fire.

Faulty electric wiring on Christmas trees is a common cause of fires that are, at least initially, localized to the tree and its immediate environment. Other causes of localized fires include smoking (particularly while in bed), cooking appliances, and improperly placed space heaters.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
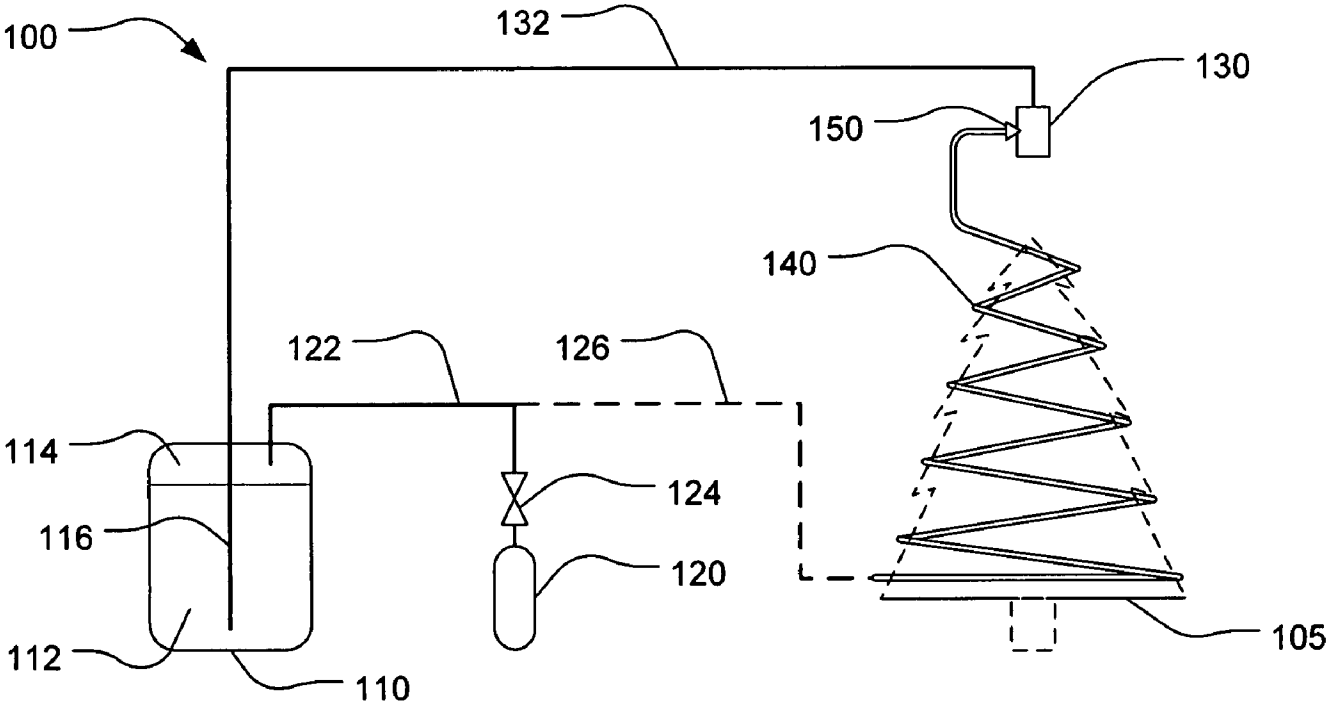
FIG. 1 is a schematic diagram of an apparatus for localized fire suppression.

Referring now to FIG. 1, an apparatus 100 for localized fire suppression may include a tank 110 of fire suppressant 112 coupled through a hose 132 to a valve 130 through which the fire suppressant 112 may be dispensed in case of a localized fire. FIG. 1 shows, as an example, the valve 130 disposed at the top of a Christmas tree 105. It should be recognized that the apparatus for localized fire suppression 100 is not limited to suppressing Christmas tree fires. The apparatus for localized fire suppression 100 may be disposed in a kitchen, bedroom, garage, or other location that may have a risk of a localized fire.

The tank 110 may contain a quantity of fire suppressant 112, which may be water or another fire suppressant material. The tank 110 may contain a quantity of precursor material that turns into a fire suppressant foam when released through the valve 130. The tank 110 may be pressurized such that, when the valve 130 releases the fire suppressant, the fire suppressant 112 may be forced out of the tank 110 through a siphon tube 116. Thus the apparatus 100 may dispense fire suppressant without the use of a pump or other mechanism that requires electricity. To suppress a fire in a Christmas tree, for example, the tank 110 may hold 3 to 4 gallons of fire suppressant 112. The tank 110 may hold a greater or smaller amount of fire suppressant 112.

The tank 110 may be pressurized by gas from a gas bottle 120. The gas bottle 120 may be coupled to the tank 110 by a gas pipe 122, which may include one or more valves 124. The tank 110 may include a volume 114 of pressurizing gas, which may be air, nitrogen, carbon dioxide or other nonflammable gas. The volume 114 of pressurizing gas may be separated from the fire suppressant 112 by a flexible diaphragm (not shown in FIG. 1) or other mechanism, if necessary to prevent absorption of the pressuring gas into the fire suppressant or other undesired interaction between the fire suppressant and the pressurizing gas.

The valve 130 may be adapted to distribute the fire suppressant 112 over an appropriate area for the anticipated localized fire. The valve 130 may be controlled by a pneumatic fire sensor which may include a tube 140 containing a gas at a pressure above a predetermined pressure level and a first pressure-detecting mechanism 150 to detect a reduction in the gas pressure within the tube 140. The first pressure-detecting mechanism 150 may be linked to the valve 130 such that the valve 130 is opened when the first pressure-detecting mechanism 150 detects that the gas pressure within the tube 140 falls below the predetermined pressure level.

In the absence of a fire, the tube 140 may be filled with a gas at a pressure greater than the predetermined pressure level. The predetermined pressure level may be, in turn, greater than atmospheric pressure. The tube 140 may be pre-filled with a gas at a pressure greater than the predetermined pressure level and closed or sealed at each end. The tube 140 may be pressurized by a gas supply, which may be the gas bottle 120 used to pressurize the tank 110. The tube may be coupled to the gas bottle 120 as shown by the dashed line 126.

The tube 140 may be fabricated from a polymer or other material that is incapable of retaining a gas at a pressure greater than the predetermined pressure level when exposed to a fire. Continuing the example of an apparatus to suppress Christmas tree fires, the tube 140 may be draped around the tree and hidden among the decorations. When exposed to a fire, the tube 140 may soften and burst, leak, melt, burn through, or otherwise fail, resulting in a drop in the pressure of the gas within the previously pressurized tube. When the tube is exposed to fire, the internal gas pressure may drop to atmospheric pressure or to some other pressure level below the predetermined pressure level. The first pressure-detecting mechanism 150 may respond to the drop in the pressure within the tube by causing or enabling the valve 130 to open and thus dispense the fire suppressant.

Figure 2:
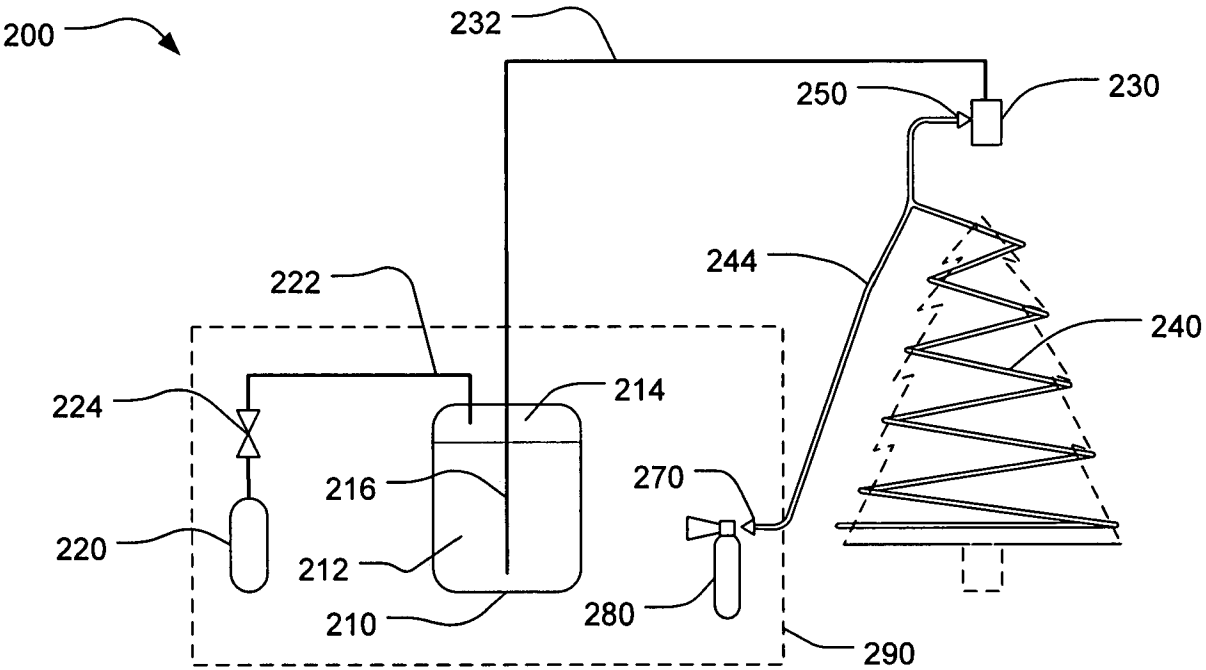
FIG. 2 is a schematic diagram of an apparatus for localized fire suppression.

Referring now to FIG. 2, an apparatus 200 for localized fire suppression may include a tank of fire suppressant 210 coupled through a hose 232 to a valve 230 through which the fire suppressant may be dispensed in case of a localized fire. The apparatus 200 may include a pneumatic fire sensor including a tube 240 containing a gas at a pressure above a predetermined pressure level, a first pressure-detecting mechanism 250 to detect a drop in the gas pressure within the tube 240, and a second pressure-detecting mechanism 270 to also detect a drop in the gas pressure within the tube 240.

The tube 240 may be fabricated from a polymer or other material that is incapable of retaining a gas at a pressure greater than the predetermined pressure level when exposed to a fire. The tube 240 may include a section 244 to couple the second pressure-detecting mechanism 270 and the first pressure-detecting mechanism 250.

The first pressure-detecting mechanism 250 may detect when the pressure within the tube 240 falls below the predetermined pressure level, causing or enabling the valve 230 to open and thus dispense the fire suppressant. The second pressure-detecting mechanism 270 may respond to the drop in the pressure within the tube section 244 by causing or enabling an air horn 280 or other audible alarm to sound to alert persons to the fire. The first pressure-detecting mechanism 240 and the second pressure-detecting mechanism 270 may be coupled to and activate a valve, an air horn, or another device.

The air horn 280 or other audible alarm, the tank 210, the gas bottle 220, and the associated tubes and piping may be contained within an enclosure 290. For example, the enclosure 290 of an apparatus specifically intended to suppress Christmas tree fires may appear to be a present that can be inconspicuously placed beneath the tree. For further example, the enclosure 290 of an apparatus specifically intended to suppress bedding fires may serve an additional function as a night stand or lamp table.

Figure 3A:
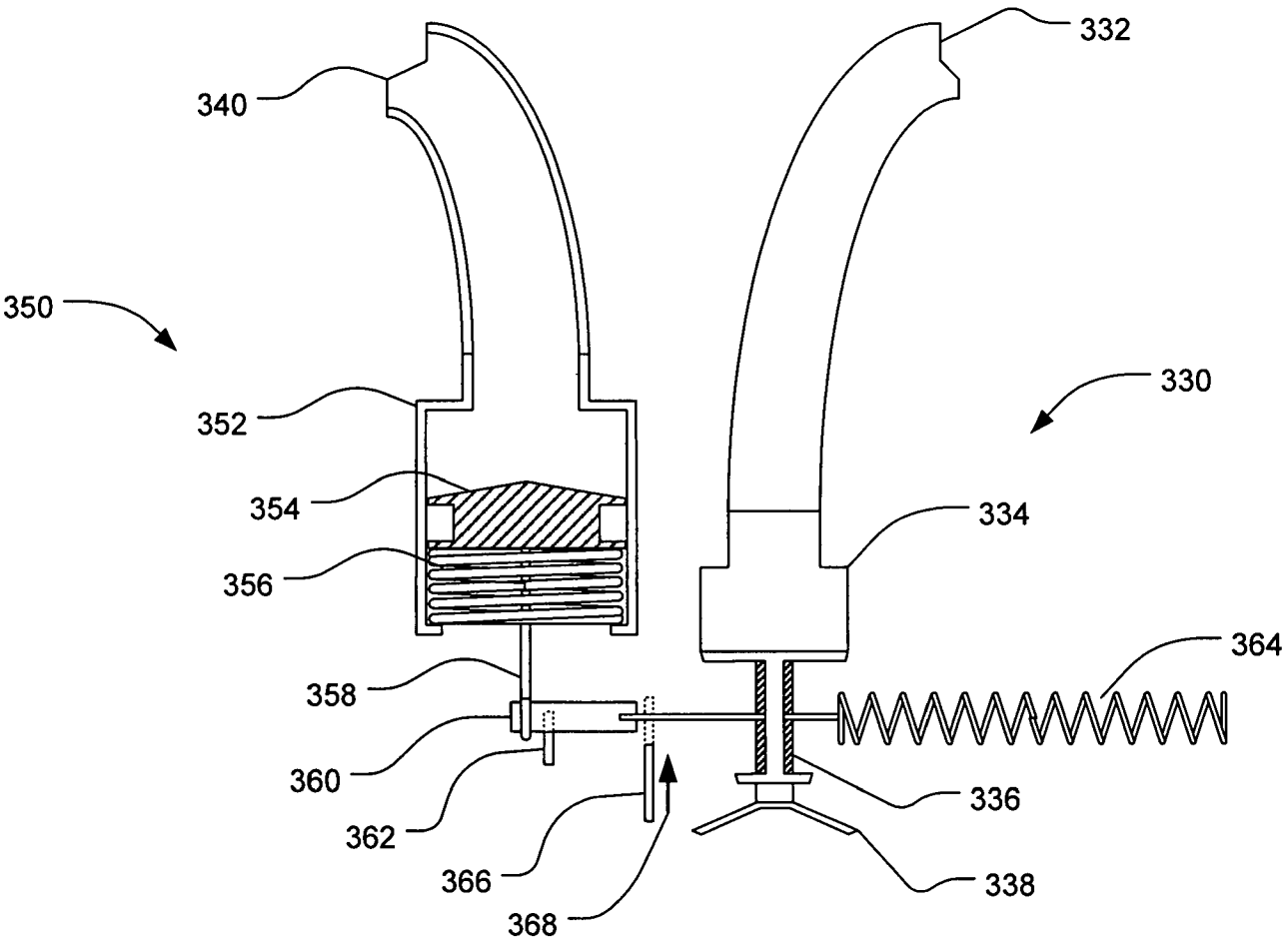
FIG. 3A is a schematic diagram of an armed pneumatically-actuated valve.

FIG. 3A is a schematic diagram of a valve 330 and a pressure-detecting mechanism 350. The valve 330 may be suitable for use as the valve 130 or 230. The pressure-detecting mechanism 350 may be suitable for use as the pressure-detecting mechanism 150 or 250. The schematic diagram shows the functional components of the valve 330 and the pressure-detecting mechanism 350 without showing the structure that supports and connects those components. FIG. 3A shows the valve 330 in the armed or ready condition. A hose 332 extending from a tank of fire suppressant (not shown) is coupled to a sprinkler head which may include a valve body 334, a frangible glass bulb 336, and a deflector 338. In the absence of a fire, a valve within the valve body 334 may be held in a closed position by the frangible glass bulb 336. The frangible glass bulb 336 may be filled with a liquid that expands when heated, such that the frangible glass bulb 336 may break due to the expansion of the liquid when the temperature exceeds a predetermined activation temperature. Breaking the frangible glass bulb 336 allows the valve 330 to open, dispensing the fire suppressant.

Temperature-sensitive frangible bulb sprinkler heads are commercially available with a range of activation temperatures. A sprinkler head having an activation temperature of 135 F, commonly used in residences, may be suitable for use as the valve 330. The deflector 338 may be adapted to distribute the fire suppressant over the expected size of a localized fire and may be different from the deflectors normally used with ceiling-mounted sprinkler heads.

Breaking the frangible glass bulb 336 due to excess temperature may be a secondary, back-up, mechanism for opening the valve 330. The primary mechanism for opening the valve 330 may be the pneumatic fire sensor 350. In the event of a fire, the pneumatic fire sensor 350 may mechanically break the frangible glass bulb with a spring-loaded breaker bar 360. The breaker bar 360 may be coupled to first spring 364 and may have a hole, slot, lip, or other feature that engages a retaining pin or bar 362. When the breaker bar 360 is engaged with the retaining pin 362, the breaker bar 360 is held in position with the first spring 364 under substantial tension.

A tube 340, normally filled with gas under pressure, is coupled to a cylinder 352. A piston 354 is disposed within the cylinder 352. The piston 354 may form a seal with the interior wall of the cylinder 352 to effectively seal the end of the tube 340. The tube 340 may terminate in an inflatable bladder (not shown) disposed in the cylinder 352. In this case, the piston 354 may not form a seal with the interior wall of the tube 352. The position of the piston 354 within the cylinder may be maintained by the balance of the gas pressure within the tube 340 and the pressure of a second spring 356 which is normally compressed by the pressure of the gas upon the piston 354. The piston 354 may be coupled to a hook 358 which may, in turn, be coupled to the breaker bar 360.

Figure 3B:
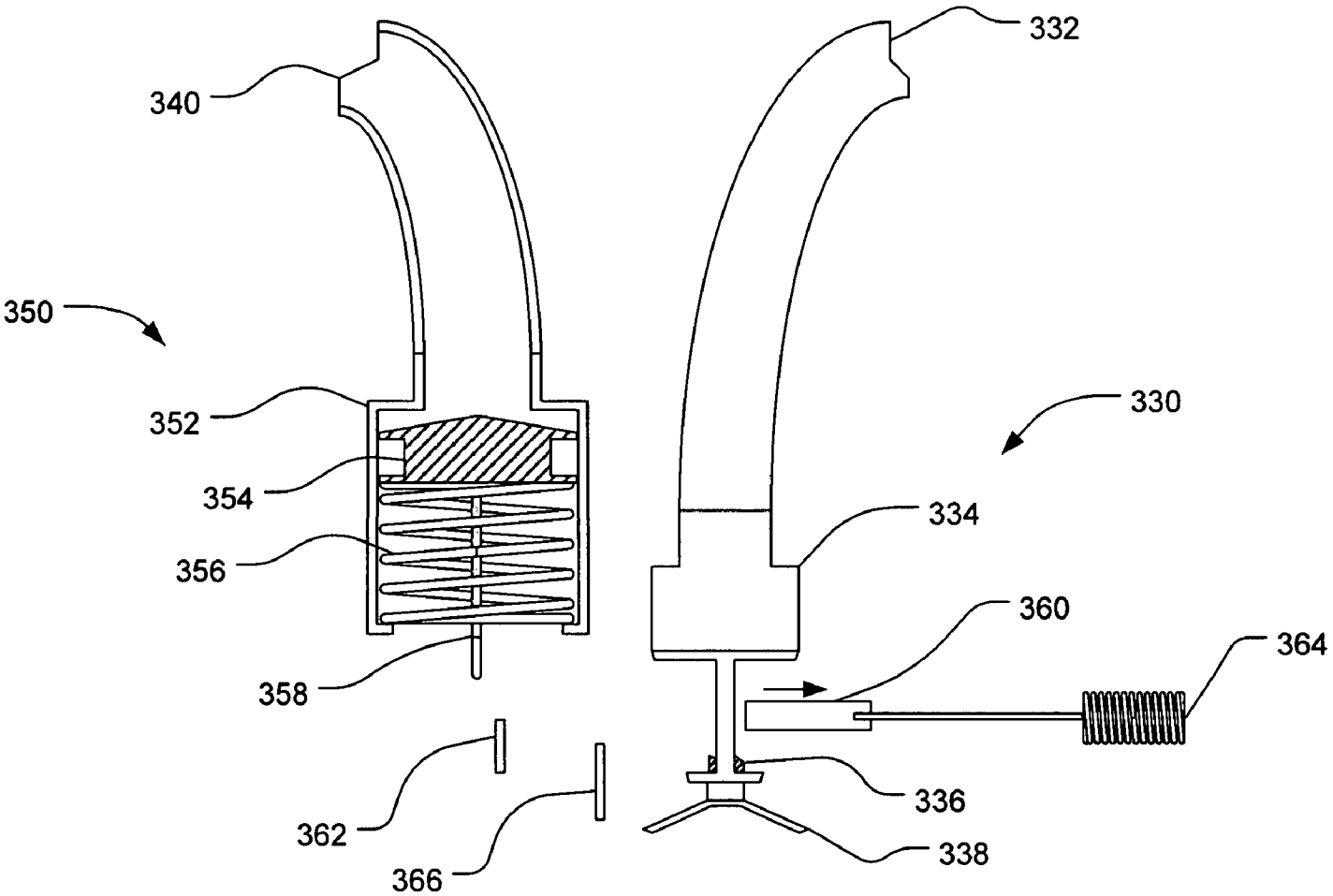
FIG. 3B is a schematic diagram of an activated pneumatically-actuated valve.

Refer now to FIG. 3B, which is a schematic diagram of a valve 330 in an activated condition, shortly after a loss of pressure within the tube 340. Upon a reduction of gas pressure within the tube 340, the force exerted by the previously compressed second spring 356 is no longer balanced by the gas pressure, allowing the second spring to expand and force the piston 354 upward within the cylinder 352. Note that upward is a relative direction consistent with FIG. 3, but does not imply any absolute orientation of the valve 330. The upward motion of the piston 354 is coupled to the hook 358 which, in turn, lifts the breaker bar 360 free of the retaining pin 362. Once the breaker bar 360 is free of the retaining pin 362, the first spring 364 contracts, pulling the breaker bar 360 into and through the frangible glass bulb 336. Breaking the frangible glass bulb 336 allows the valve 330 to open to dispense the fire suppressant.

Safety pin 366 may be engaged, as shown by the arrow 368 in FIG. 3A, to restrain the breaker bar and prevent activation of the valve regardless of the pressure within the tube 340.

The combination of cylinder 352, the piston 354, the first and second springs 356/364, the breaker bar 360, and the retaining pin 362 is an example of a pressure-detecting mechanism to detect a loss in pressure within the tube 340. The use of the spring loaded breaker bar to break the frangible glass bulb of a sprinkler head is an example of a linkage between the first pressure detecting mechanism and a valve. These components may be assembled in numerous physical configurations in addition to the configuration illustrated in FIGS. 3A and 3B. Additionally, other combinations of springs, levers, linkages, and other mechanical components may be employed. For example, if the back-up mechanism provided by the temperature-sensitive sprinkler head is not required, the valve 330 may be a spring-loaded valve held in the closed position by a retaining pin which may be released by the action of the piston 354.

Figure 4:
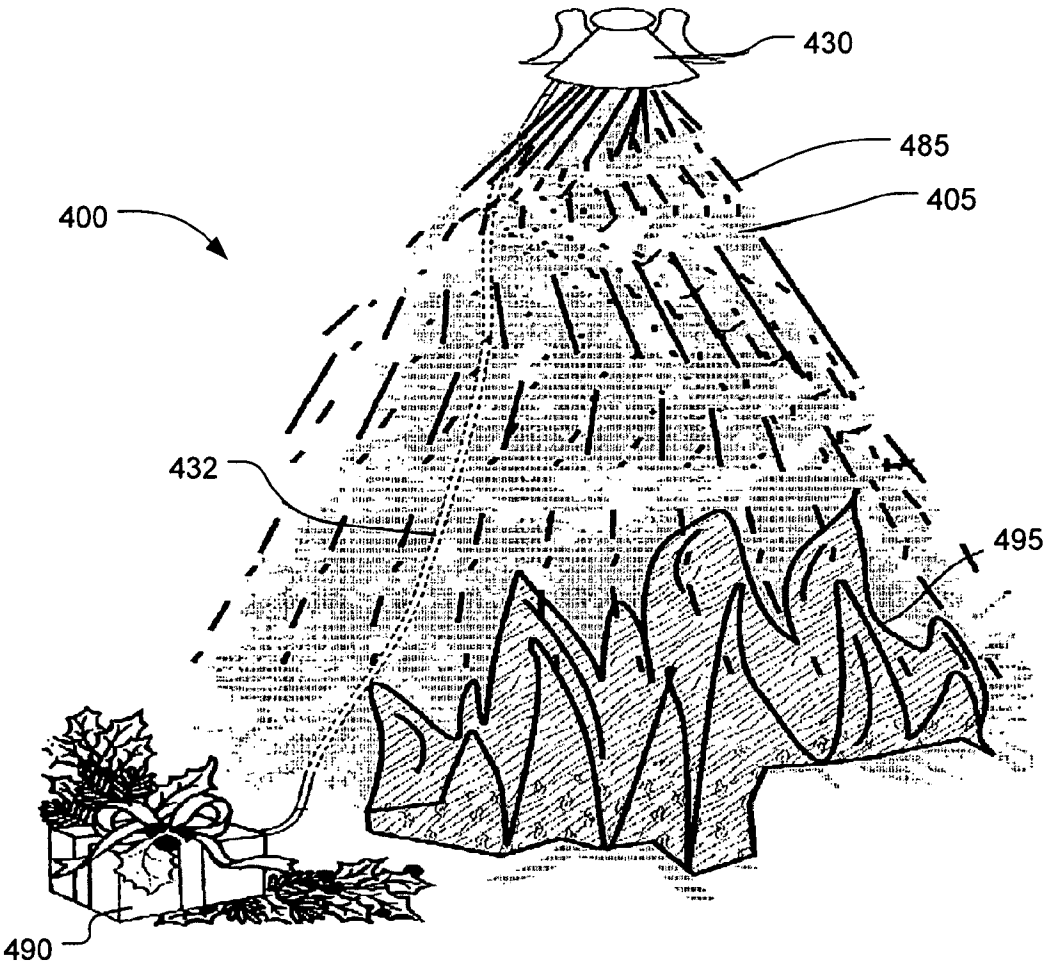
FIG. 4 is a view of a representative application of an apparatus for localized fire suppression.

FIG. 4 is a view of a exemplary deployment of an apparatus 400 for localized fire suppression to suppress a fire in a Christmas tree 405. The apparatus 400 may include a enclosure 490, which may be disguised as a present, containing a pressurized reservoir of fire suppressant (not visible). The reservoir may be coupled to a valve 430, which may be disguised as an ornament, by a hose 432. The vale 430 may be coupled to a pneumatic fire sensor which is hidden within the tree 105 and its decorations. The fire 495 may cause the pneumatic fire sensor to open the valve 430, releasing the fire suppressant 485.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. An apparatus to suppress a localized fire, comprising
- a pressurized tank of fire suppressant
- a temperature-activated sprinkler head valve coupled to the tank, the valve including a frangible glass bulb
- a pneumatic fire sensor to open the valve to release the fire suppressant, the pneumatic fire sensor comprising:
  - a tube that retains a gas at a pressure above a predetermined pressure level in the absence of a fire
  - a first pressure-detecting mechanism to break the frangible glass bulb upon a determination that the pressure in the tube is below the predetermined pressure level.

2. The apparatus of claim 1, wherein the tank is coupled to the valve by a length of hose such that the valve may be located remote from the tank.

3. The apparatus of claim 1, wherein the tank is pressurized by a bottle of compressed gas.

4. The apparatus of claim 1, wherein the fire suppressant is selected from the group consisting of water and fire retardant foam precursor.

5. The apparatus of claim 1, further comprising an audible alarm controlled by the pneumatic fire sensor.

6. The apparatus of claim 1, further comprising
- a second pressure-detecting mechanism to determine when the pressure in the tube drops below the predetermined pressure level, the second pressure-detecting mechanism coupled to an audible alarm.

7. The apparatus of claim 1, wherein the first pressure-detecting mechanism comprises a spring-loaded breaker bar to break the frangible glass bulb.

8. The apparatus of claim 7, wherein
- the spring-loaded breaker bar is retained in a ready position so long as the pressure in the tube is above the predetermined pressure level
- the spring-loaded breaker bar is released to break the frangible glass bulb when the pressure in the tube falls below the predetermined pressure level.

9. The apparatus of claim 1, wherein the tube comprises a material that is incapable of retaining the gas at a pressure above the predetermined pressure level when the tube is exposed to a fire.

10. The apparatus of claim 9, wherein the tube comprises a polymer material that, when exposed to a fire, does at least one of melting, bursting, leaking, softening, vaporizing, and burning.

11. A pneumatic fire sensor comprising
- a tube, the tube retaining a gas at a pressure above a predetermined pressure level in the absence of a fire
- a first pressure detecting mechanism to determine when the pressure in the tube drops below the predetermined pressure level
- a temperature-activated sprinkler head valve activated by the first pressure-detecting mechanism upon determination that the pressure in the tube is below the predetermined pressure level
- wherein the valve includes a frangible glass bulb, and the first pressure-detecting mechanism breaks the frangible glass bulb upon determination that the pressure in the pressurized tube is below the predetermined pressure level.

12. The pneumatic fire sensor of claim 11, wherein the first pressure-detecting mechanism comprises a spring-loaded breaker bar to break the frangible glass bulb.

13. The pneumatic fire sensor of claim 12, wherein
- the spring-loaded breaker bar is retained in a ready position so long as the pressure in the pressurized tube is above the predetermined pressure level
- the spring-loaded breaker bar is released to break the frangible glass bulb if the pressure in the pressurized tube falls below the predetermined pressure level.

14. The pneumatic fire sensor of claim 11, wherein the tube comprises a material that is incapable of retaining the gas at a pressure above the predetermined pressure level when the tube exposed to a fire.

15. The pneumatic fire sensor of claim 14, wherein the tube comprises a polymer material that, when exposed to a fire, does at least one of melting, softening, bursting, leaking, vaporizing, and burning.

16. The pneumatic fire sensor of claim 11, further comprising:
- a second pressure detecting mechanism to determine when the pressure in the tube drops below the predetermined pressure level
- an audible alarm activated by the second pressure-detecting mechanism upon determination that the pressure in the tube is below the predetermined pressure level.

17. An apparatus to suppress a localized fire, comprising a pressurized tank of fire suppressant a valve coupled to the tank a pneumatic fire sensor to open the valve to release the fire suppressant, the pneumatic fire sensor comprising:

a tube that retains a gas at a pressure above a predetermined pressure level in the absence of a fire, wherein the tube comprises a material that is incapable of retaining the gas at a pressure above the predetermined pressure level when the tube is exposed to a fire a first pressure-detecting mechanism to determine when the pressure in the tube drops below the predetermined pressure level, the first pressure-detecting mechanism coupled to the valve, wherein the valve may release the fire suppressant when the temperature of at least a portion of the valve exceeds a predetermined activation temperature.

18. The apparatus of claim 17, wherein the tank is coupled to the valve by a length of hose such that the valve may be located remote from the tank.

19. The apparatus of claim 17, wherein the tank is pressurized by a bottle of compressed gas.

20. The apparatus of claim 17, wherein the fire suppressant is selected from the group consisting of water and fire retardant foam precursor.

21. The apparatus of claim 17, further comprising an audible alarm controlled by the pneumatic fire sensor.

22. The apparatus of claim 17, wherein the tube comprises a polymer material that, when exposed to a fire, does at least one of melting, bursting, leaking, softening, vaporizing, and burning.

* * * * *